US010434671B2

(12) United States Patent
Manshoory

(10) Patent No.: US 10,434,671 B2
(45) **Date of Patent: *Oct. 8, 2019**

(54) TRAVEL RAZOR

(71) Applicant: SPHYNX COLLECTION, LLC, Los Angeles, CA (US)

(72) Inventor: Leila Kashani Manshoory, Los Angeles, CA (US)

(73) Assignee: Sphynx Collection, LLC, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/458,942

(22) Filed: Mar. 14, 2017

(65) Prior Publication Data

US 2017/0274542 A1 Sep. 28, 2017

Related U.S. Application Data

(63) Continuation of application No. 14/661,605, filed on Mar. 18, 2015, now Pat. No. 9,630,333, which is a continuation-in-part of application No. 14/552,403, filed on Nov. 24, 2014, now abandoned.

(60) Provisional application No. 61/973,204, filed on Mar. 31, 2014.

(51) Int. Cl.
*B26B 21/44* (2006.01)
*B26B 21/40* (2006.01)

(52) U.S. Cl.
CPC ..... *B26B 21/446* (2013.01); *B26B 21/4037* (2013.01)

(58) Field of Classification Search
CPC .... B26B 21/446; B26B 21/4037; B26B 21/44
See application file for complete search history.

(56) References Cited

U.S. PATENT DOCUMENTS

| | | | | | |
|---|---|---|---|---|---|
| 2,790,234 | A | * | 4/1957 | Goldstein | B26B 21/446 30/41 |
| D218,669 | S | * | 9/1970 | Genaro | D28/46 |
| 3,648,365 | A | * | 3/1972 | Iten | B26B 21/24 30/346.57 |
| 4,074,429 | A | * | 2/1978 | Roberts | B26B 21/44 30/41 |
| 4,077,119 | A | * | 3/1978 | Sellera | B26B 21/446 30/41 |
| 4,241,500 | A | * | 12/1980 | Iten | B26B 21/185 30/40 |
| 4,635,361 | A | * | 1/1987 | DeMars | B26B 21/446 30/41 |
| 5,092,041 | A | * | 3/1992 | Podolsky | B26B 21/446 30/34.2 |

(Continued)

FOREIGN PATENT DOCUMENTS

| | | | |
|---|---|---|---|
| CN | 202775771 U | | 3/2013 |
| GB | 2 248 033 A | * | 3/1992 |
| GB | 2 342 884 A | * | 4/2000 |

*Primary Examiner* — Hwei-Siu C Payer
(74) *Attorney, Agent, or Firm* — Kagan Binder, PLLC

(57) ABSTRACT

A portable razor is disclosed, comprising a body comprising at least three edge sides, a first razor blade attached to a first edge side of the body, a water container contained within the body, the water container comprising a sprayer arranged on a second edge side of the body and a shaving lubricant attached to a third edge side of the body.

11 Claims, 6 Drawing Sheets

(56) References Cited

U.S. PATENT DOCUMENTS 5,241,751 A * 9/1993 Goh ..... B26B 21/40 30/41
5,337,478 A * 8/1994 Cohen ..... B26B 21/446 30/41
5,564,190 A * 10/1996 Fleetwood ..... B26B 21/446 30/41
5,669,139 A * 9/1997 Oldroyd ..... B26B 21/222 30/47
6,308,413 B1 * 10/2001 Westerhof ..... B26B 19/38 30/41
6,568,083 B1 5/2003 Taniguchi et al.
7,007,389 B1 * 3/2006 Arif ..... A45D 34/04 206/228
7,043,841 B2 * 5/2006 Franzini ..... B26B 21/446 30/41
7,043,842 B1 * 5/2006 Taylor ..... B26B 21/44 30/41.5
7,086,159 B2 * 8/2006 Motta ..... B26B 21/165 30/50
7,127,817 B2 * 10/2006 Orloff ..... A45D 27/04 30/41
7,162,800 B2 * 1/2007 Orloff ..... B26B 21/225 30/41
7,266,895 B2 * 9/2007 Pennella ..... B26B 21/222 30/47
D566,334 S * 4/2008 Shoavi ..... D28/46
7,574,802 B2 * 8/2009 Pennella ..... B26B 21/44 30/41
D635,301 S * 3/2011 Cormier ..... D28/46
D635,391 S * 4/2011 Sakai ..... D7/350.1
8,424,210 B2 * 4/2013 Moore ..... B26B 21/222 30/346.57
D697,263 S * 1/2014 Szymanski ..... D28/48
8,663,240 B2 3/2014 Kling et al.
8,883,075 B2 * 11/2014 Henry ..... A45D 27/46 206/208
D744,164 S * 11/2015 Manshoory ..... D28/46
9,630,333 B2 * 4/2017 Manshoory ..... B26B 21/446
2002/0029478 A1 * 3/2002 Haws ..... B26B 21/446 30/41.5
2002/0050065 A1 * 5/2002 Kludjian ..... B26B 21/22 30/50
2004/0255465 A1 * 12/2004 Pennella ..... B26B 21/446 30/41
2006/0101647 A1 * 5/2006 Gilder ..... B26B 21/22 30/50
2007/0011879 A1 * 1/2007 Orloff ..... A45D 27/04 30/41
2010/0064521 A1 * 3/2010 DeLong ..... B26B 21/40 30/41
2013/0305537 A1 * 11/2013 Svedman ..... B26B 21/40 30/41
2014/0033537 A1 * 2/2014 Ramakrishnan ..... B26B 21/446 30/41
2015/0135542 A1 5/2015 Cook
2015/0273710 A1 * 10/2015 Manshoory ..... B26B 21/446 30/41
2015/0290821 A1 * 10/2015 Manshoory ..... B26B 21/446 30/41

* cited by examiner

TRAVEL RAZOR

CROSS-REFERENCE TO RELATED APPLICATIONS

The present application is a continuation of application Ser. No. 14/661,605, filed Mar. 18, 2015, now U.S. Pat. No. 9,630,333, which is a continuation-in-part of application Ser. No. 14/552,403, filed Nov. 24, 2014, now abandoned, which takes priority from Provisional Application No. 61/973,204, filed Mar. 31, 2014, which are incorporated herein by reference.

BACKGROUND

Shaving is a normal part of life for both men and women. While most people shave in the bathroom or the shower as part of their normal routine, occasionally people require a razor while on-the-go. For example, a woman may notice an area she missed while shaving in the morning, and require a touch-up; a woman may be simply too busy to shave or have forgotten to shave that morning; a traveling professional may require a portable razor for a quick shave at the airport before an important meeting; and so on. All of those applications require a razor that is readily available and easy to use on the go.

For this reason, many women carry a standard razor with them and dry-shave when the need arises. However, dry-shaving irritates the skin and does not deliver a close shave. For a closer and less irritating shave, water and soap or other shaving lubricant are needed. However, it is cumbersome and inconvenient for a user to carry water, soap, and a razor when out and about. A need exists for a portable razor that incorporates water and a shaving lubricant in a way that more faithfully duplicates the home shaving experience.

SUMMARY OF THE INVENTION

An object of the present invention is to provide a portable razor that supplies a water source, a shaving lubricant, and at least one razor blade in a portable, leak-proof package that can be easily carried.

In an embodiment, the present invention comprises a body, a razor blade attached to the body, a shaving lubricant attached to the body, and a water container with a sprayer attached to the body. The razor blade is preferably removable and replaceable, as is the shaving lubricant. The water container is preferably refillable. In an embodiment, a second razor blade is also attached to the body.

In an embodiment, the razor blade (or razor blades) is retractable into the body when not in use. The present invention may also comprise a razor cap covering the razor blade when not in use.

In an embodiment, the shaving lubricant is a soap bar. The soap bar may be retractable into the body; the present invention may also comprise a soap bar cap covering the soap bar when not in use.

In an embodiment, the water container is refillable. The shaving lubricant may also be refillable.

In the preferred embodiment, the present invention comprises a housing that comprises an axis of rotation, and an opening. An inner body is located within the housing, and is mounted in such a way as to rotate around the axis of rotation. A first razor blade, a shaving lubricant, and a water sprayer are mounted on the inner body in such a way as to be exposed through the opening when the inner body is rotated. The water sprayer is connected to a water container. The present invention also comprises a cap to cover the opening.

In an embodiment, a second razor blade is also mounted on the inner body in such a way as to be exposed through the opening when the inner body is rotated.

The shaving lubricant is preferably a soap bar. In the preferred embodiment, the soap bar is removable. Other shaving lubricants may also be used.

The water container is preferably refillable, and may also be removable for easier refilling.

The inner body is preferably triangular, but may also be rectangular if a second razor blade is included. Any other shape may be used as long as it permits the razor blade or blades, the shaving lubricant, and the water sprayer to be exposed through the opening when the inner body is rotated.

The housing is preferably round, but may be any other shape as long as the inner body may rotate freely within it and the razor blade or blades, shaving lubricant, and water sprayer are exposed when the inner body is rotated.

In an embodiment, the present invention may also comprise a razor cleaning device for cleaning stray hairs out of the razor during shaving.

LIST OF FIGURES

FIG. 1 shows the preferred embodiment of the travel razor of the present invention with the cap on.

DETAILED DESCRIPTION OF THE PREFERRED EMBODIMENT

Figure 1:
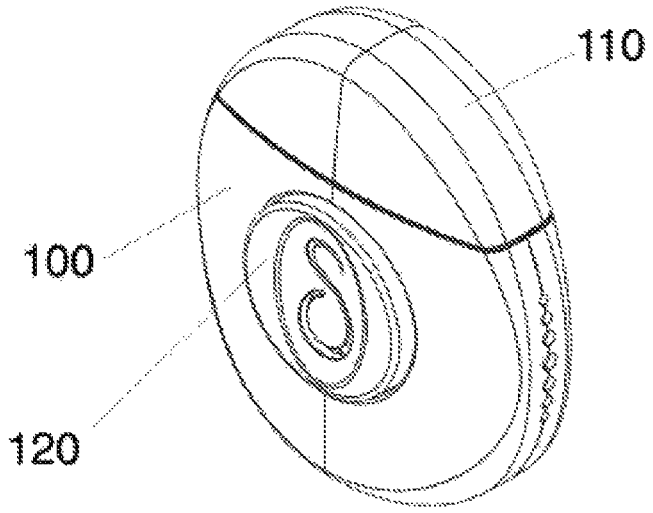

FIG. 1 shows the housing 100 of the razor of the preferred embodiment of the present invention, with the cap 110 on. The cap 110 is preferably tightly fitted to the housing 100 to prevent accidental leaks. In an embodiment, the fit between the cap 110 and the housing 100 is watertight. In the preferred embodiment, the cap 110 snaps onto the housing 100 in a way that would prevent it from becoming accidentally dislodged while being carried in a pocket or purse. As shown in the Figure, housing 100 comprises a circular hole; a circular protrusion 120 on the inner body of the razor is inserted in the circular hole and able to rotate within the circular hole. In the preferred embodiment, such circular protrusions and circular holes are present on both sides of the razor. This locks the inner body within the housing and enables it to rotate freely within the housing.

Figure 2A:
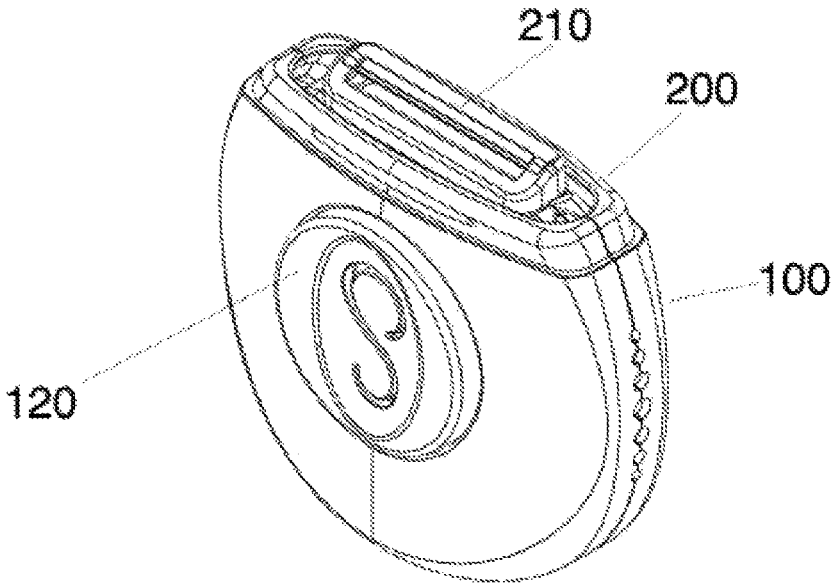
FIGS. 2A-2C show the preferred embodiment of the travel razor of the present invention with the cap off.
Figure 2B:
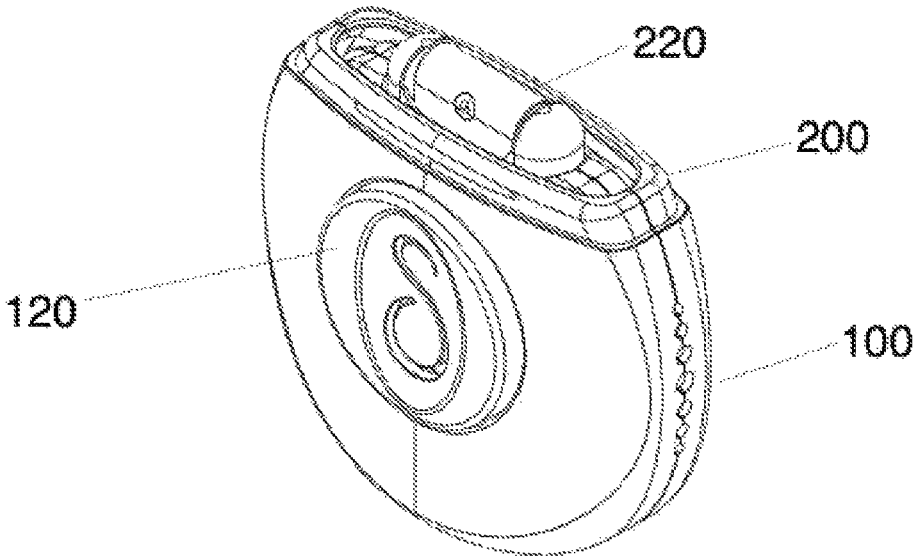
Figure 2C:
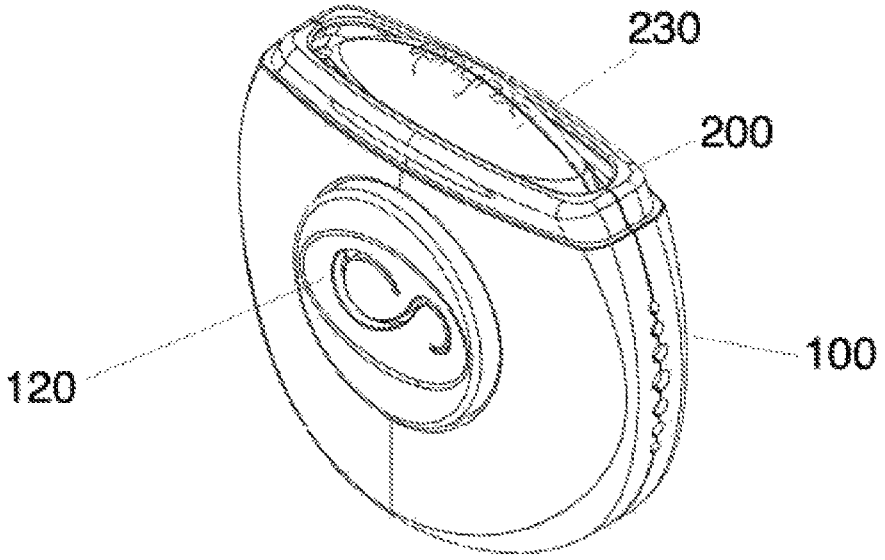

FIGS. 2A-2C show the razor of the preferred embodiment of the present invention with the cap off and with different attachments showing through the opening 200 in the housing 100. In the preferred embodiment, the inner body of the travel razor of the present invention comprises two razor blades, a water sprayer, and a soap bar. Any other number of razor blades may be used depending on user needs. A user can rotate any of those attachments into position by rotating the circular protrusion 120. FIG. 2A shows one of the razor blades 210 showing through the opening; FIG. 2B shows the water sprayer 220 showing through the opening; and FIG. 2C shows the soap bar 230 showing through the opening.

A user would preferably use the razor of the preferred embodiment of the present invention by taking off the cap, using the water sprayer 220 to spray some water on the area that requires a touch-up shave, then rotating the soap bar 230 into position and soaping up the area, and then rotating one of the razor blades 210 into position to shave the area. This enables the user to get a close shave of the same quality they would get when shaving at home, with no irritation or dry skin.

Figure 3:
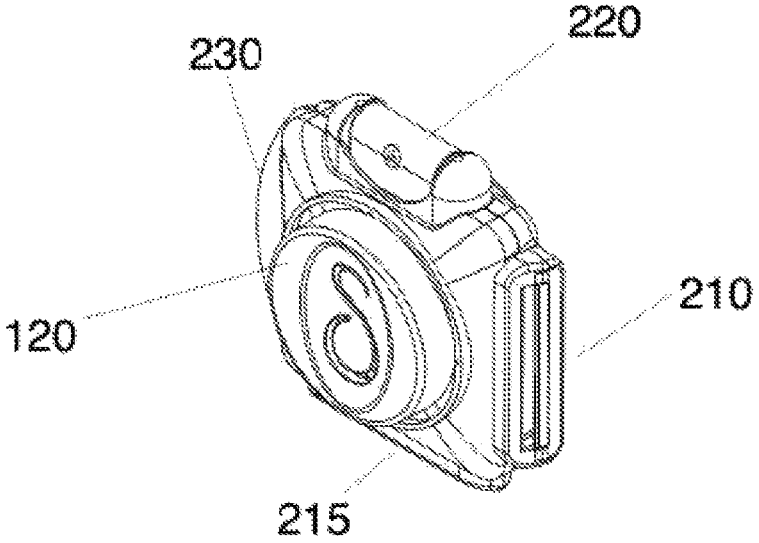
FIG. 3 shows a view of the inner body of the travel razor of the present invention.

FIG. 3 shows a view of the inner body of the razor of the present invention. In the preferred embodiment, the inner body has four sides. A first razor blade 210 is mounted on one of the sides, and a second razor blade 215 is mounted on another side, as shown in the Figure. In the preferred embodiment, the razor blades are standard blade cartridges such as used in women's razors, and are removable and replaceable.

The third side of the inner body is taken up by a shaving lubricant 230. In the preferred embodiment, the shaving lubricant is a solid bar of soap or specialized shaving soap, as shown in FIG. 3. The shaving lubricant is preferably removable and replaceable. In an embodiment, a user may be able to choose from several different varieties of shaving lubricant to install in the present invention, differing in softness, scent (or unscented), moisturizing properties, and so on. In an embodiment, the shaving lubricant is a moisturizer that is easily absorbed by the skin (so that the user would not need to wash it off after shaving).

The fourth side of the inner body is taken up by a water sprayer 220, connected to a water container. The water sprayer 220 is preferably a standard sprayer that is leakproof and that can deliver a sufficient amount of water to the skin in a fine mist that does not cause dripping.

The middle of the inner body comprises a circular protrusion 120 that enables the inner body to be rotated with respect to the housing. In the preferred embodiment, the inner body "snaps" into position when each one of the attachments is positioned in the opening. In the preferred embodiment, the inner body comprises two circular protrusions 120, one on each side. This facilitates rotation.

In alternate embodiments, the circular protrusion 120 can comprise a handle or key that facilitates rotation.

Figure 4:
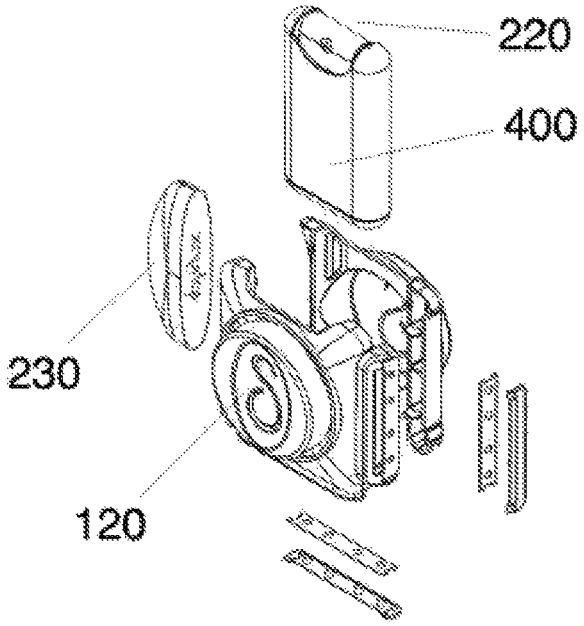
FIG. 4 shows an exploded view of the inner body of the travel razor of the present invention.

FIG. 4 shows an exploded view of the inner body. As can be seen in the Figure, the water sprayer 220 is connected to a water container 400 that preferably can contain a sufficient amount of water for at least one brief shave. The water container 400 is preferably lightweight and leakproof. In an embodiment, the water container is refillable, and may be opened. In another embodiment, the water container is disposable and cannot be opened.

As shown in FIG. 4, the shaving lubricant 230 is a solid bar that attaches to the inner body by a friction fit. Other methods of mounting the shaving lubricant 230 in the inner body are also possible.

The above description is that of the preferred embodiment. Other embodiments of the invention are also possible and are limited solely by the appended claims.

The invention claimed is:

1. A travel razor, comprising:

a housing comprising an opening;

a body comprising at least a first side, a second side, and a third side;

a first razor blade attached to the first side of the body;

a water container contained within the body, said water container comprising a sprayer arranged on the second side of the body;

a shaving lubricant attached to the third side of the body, wherein the body comprises an axis of rotation such that when the body is rotated about the axis of rotation, the first razor blade, the sprayer, and the shaving lubricant all move along a common circular path so that the same one of any one of the first razor blade, the sprayer, and the shaving lubricant can be positioned and repositioned through the opening of the housing for use.

2. The travel razor of claim 1, further comprising:

a second razor blade attached to a fourth side of the body.

3. The travel razor of claim 2, wherein when the body is rotated about the axis of rotation, the first razor blade, the second razor blade, the sprayer and the shaving lubricant all move along the common circular path.

4. The travel razor of claim 1, where the shaving lubricant is a soap bar, further comprising a soap bar cap covering the soap bar.

5. The travel razor of claim 4, where the soap bar is retractable.

6. The travel razor of claim 1, further comprising a sprayer cap covering the sprayer.

7. The travel razor of claim 1, where the razor blade is retractable into the body.

8. The travel razor of claim 1, further comprising a razor cap covering the razor blade.

9. The travel razor of claim 1, where the razor blade is removable.

10. The travel razor of claim 1, where the water container is refillable.

11. The travel razor of claim 1, where the shaving lubricant is refillable.

* * * * *